US006805208B2

(12) United States Patent
Kusmierski et al.

(10) Patent No.: US 6,805,208 B2
(45) Date of Patent: Oct. 19, 2004

(54) SWITCH LOCK-OFF MECHANISM FOR POWER TOOLS

(75) Inventors: Robert Kusmierski, Felton, PA (US); Bradley J. Mealy, Abingdon, MD (US)

(73) Assignee: Black & Decker Inc., Newark, DE (US)

( * ) Notice: Subject to any disclaimer, the term of this patent is extended or adjusted under 35 U.S.C. 154(b) by 6 days.

(21) Appl. No.: 10/211,741

(22) Filed: Aug. 2, 2002

(65) Prior Publication Data

US 2004/0020670 A1 Feb. 5, 2004

(51) Int. Cl.[7] ..... H01H 9/20

(52) U.S. Cl. ..... 173/170; 173/217; 83/DIG. 1; 83/581; 30/520

(58) Field of Search ..... 173/217, 170; 30/390, 391, 520; 83/DIG. 1, 523, 581

(56) References Cited

U.S. PATENT DOCUMENTS

| | | | | |
|---|---|---|---|---|
| 4,122,320 A | * | 10/1978 | Edgell et al. | 200/43.17 |
| 5,005,295 A | * | 4/1991 | Fushiya | 30/390 |
| 5,101,567 A | * | 4/1992 | Cool | 83/DIG. 1 |
| 5,483,727 A | * | 1/1996 | Chang | 83/DIG. 1 |
| 5,577,600 A | * | 11/1996 | Schoene et al. | 200/43.17 |
| 5,681,214 A | * | 10/1997 | Kleider et al. | 451/358 |
| 5,969,312 A | * | 10/1999 | Svetlik et al. | 83/DIG. 1 |
| 6,070,676 A | * | 6/2000 | Nelson et al. | 173/170 |

FOREIGN PATENT DOCUMENTS

| | | |
|---|---|---|
| DE | 199 38 523 A | 4/2000 |
| EP | 0 981 143 A | 10/1999 |

OTHER PUBLICATIONS

L. Findeli, European Search Report on Application No. EP 03 01 6204, Nov. 12, 2003, Munich.

Annex to the European Search Report on European Patent Application No. EP 03 01 6204.

* cited by examiner

*Primary Examiner*—Stephen F. Gerrity
*Assistant Examiner*—Michelle Lopez
(74) *Attorney, Agent, or Firm*—Adan Ayala

(57) ABSTRACT

A power tool includes a motor, a housing forming a handle, and a power switch disposed within the handle operatively associated with the motor. The power switch is movable between "on" and "off" positions via a trigger. The trigger is pivotable about a first axis. A lock-out link is pivotably attached to the housing. The lock-out link is movable between a first position contacting the power switch for preventing movement of the power switch to the "on" position, and a second position not contacting the power switch, allowing movement of the power switch to the "on" position. The lock-out link pivots between the first and second positions about a second axis non-parallel to the first axis. In addition, a first button is disposed on the housing for moving the lock-out link between the first and second positions.

16 Claims, 1 Drawing Sheet

SWITCH LOCK-OFF MECHANISM FOR POWER TOOLS

FIELD OF THE INVENTION

This invention relates generally to in general to power tools, and, in particular to a power tool with an ambidextrous lock-out mechanism for use with lockable power switches.

BACKGROUND OF THE INVENTION

Lock-out mechanisms for lockable power switches are known in the art. These mechanisms are intended to unlock the locked power switch or trigger of a motor driven tool or machine in order to allow the actuation of the motor by the power switch. The power switch of many power tools such as circular saws, table saws of various sorts, hedge trimmers and the like is provided with a lock mechanism in order to prevent unintended operation of a power tool or machine through inadvertent actuation of the power switch prior to operation of the power tool or machine. The user is required to actuate the lock-out mechanism in order to bring the lock mechanism of the power switch in an unlocked position in which the power switch can be depressed and, accordingly, the motor can be actuated.

In an electrically powered miter saw, for instance, used here for example only and not by way of limitation, a motor is used to power a circular saw blade mounted on an cantilevered arm. A platform including guides is also provided. The blade has a housing which covers the unused area of the blade. In this example, as in many power tools, a handle is attached to extend above or besides the blade for convenient operation of the saw, and on the handle is installed a power lever or switch which can be of the trigger-switch variety.

When using the saw, the user may hold the item to be sawed with one hand, and subsequently raise and lower the saw blade with the other hand. For example, in order to make a mitered cut in a length of wood trim, the user first positions the wood on a platform located below the blade. The user then turns the machine power on by grasping the handle and squeezing or depressing the power lever switch. Without removing the hand from the handle, the user then lowers the saw blade down onto the trim while holding the work piece on the platform with the other hand in order to make the desired cuts. Once cutting is complete, without removing the hand from the handle, the user raises the handle and turns off the saw by releasing the power switch. After release the power switch moves back to its rest position in which the motor is inactuated.

In many power tools including saws, the power switch will be locked by lock means as soon as it comes into its rest position. If locked, the power switch cannot be moved into the actuation position in which the motor starts turning. To operate the tool or machine, the user has to actuate the lock-out means first in order to release the power switch.

Many of the prior art lock-out mechanisms, however, are designed for the right-handed individual. In an embodiment with a grip handle arranged in a substantially horizontal manner the lock-out mechanism is positioned left to the power switch. In this case the mechanisms involve intended movement of the right thumb in order to actuate the lock-out mechanism. Left-handed operators, however, must either use both hands for unlocking and depressing the power switch, or they must inconveniently use their right hand for operation of the saw. Thus, left-handed operators are unable to realize the same ergonomic benefits from the lock-out mechanisms as do right-handed operators.

U.S. Pat. No. 5,969,312 discloses an ambidextrous lock-out mechanism. However, such mechanism is difficult to use.

SUMMARY OF THE INVENTION

In accordance with the present invention, an improved power tool is employed. The power tool includes a motor, a housing forming a handle, a power switch disposed within the handle operatively associated with the motor, the power switch being movable between "on" and "off" positions via a trigger which is pivotable about a first axis, a lock-out link pivotably attached to the housing, the lock-out link movable between a first position contacting the power switch for preventing movement of the power switch to the "on" position, and a second position not contacting the power switch, allowing movement of the power switch to the "on" position, the lock-out link pivoting between the first and second positions about a second axis non-parallel to the first axis, and a first button disposed on the housing for moving the lock-out link between the first and second positions.

Additional features and benefits of the present invention are described, and will be apparent from, the accompanying drawings and the detailed description below.

BRIEF DESCRIPTION OF THE DRAWINGS

The accompanying drawings illustrate preferred embodiments of the invention according to the practical application of the principles thereof, and in which:

FIG. 4 is a partial cross-sectional view along line IV—IV, where

DETAILED DESCRIPTION

The invention is now described with reference to the accompanying figures, wherein like numerals designate like parts. Persons skilled in the art shall recognize that while a miter saw has been used to illustrate the invention, the invention can be used in other power tools.

Figure 1:
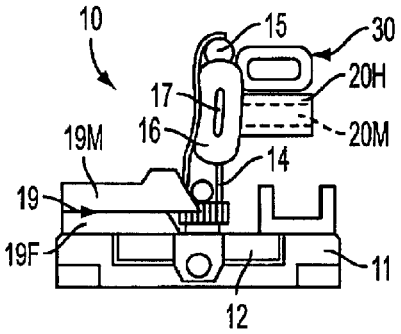
FIG. 1 is a front view of a miter saw having a handle constructed with the principles of the invention.
Figure 2:
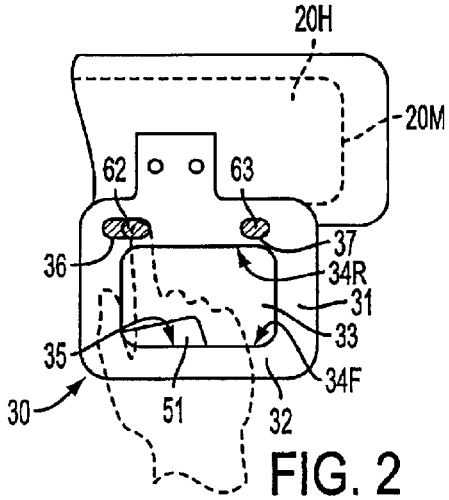
FIG. 2 is a top plan view of the handle according to the invention.
Figure 3:
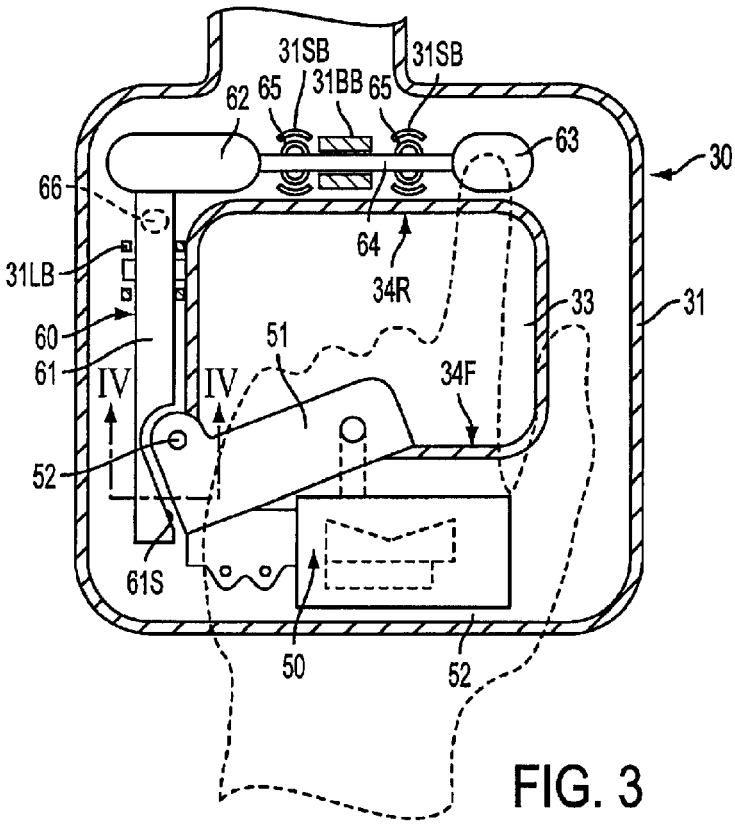
FIG. 3 is a partial cross-sectional view of the handle of FIG. 2.

Miter saws designed for cutting a workpiece are well known in the art. Referring to FIGS. 1–3, a miter saw 10 typically has a base 11, which may include a rotatable table 12 rotatably attached to base 11. A pivot arm 14 is pivotally attached to a trunnion (not shown) to allow a chopping function. The trunnion in turn may be pivotally attached to the base 11 and/or table 12, to allow the trunnion and pivot arm 14 to pivot relative to the base 11.

The pivot arm 14 carries a saw assembly which includes motor housing 20H, a motor 20M disposed in motor housing 20H, a blade 17 driven by motor 20M, an upper blade guard 15 covering an upper part of the blade 17, and a lower blade guard 16 pivotally attached to upper blade guard 15 for covering a lower part of the blade 17.

A fence assembly 19 may be provided on both sides of blade 17. Persons skilled in the art are referred to the fence assemblies disclosed in U.S. Pat. Nos. 5,297,463 and 5,733,148, which are wholly incorporated herein by reference. Fence assembly 19 has a fixed fence 19F disposed on base 11, and a movable fence 19M slidably disposed on fixed fence 19F.

Motor housing 20H and/or upper blade guard 15 may support handle housing 30. Handle housing 30 may include a housing 31 having rear and front ends 34R, 34F, respectively, a grip portion 32, and an opening 33 through which fingers may extend to firmly grasp grip portion 32 (and thus handle housing 30). Preferably grip portion 32 is on the front end 34F. Grip portion 32 may extend in a substantially horizontal plane and may have a longitudinal axis which is substantially horizontal.

A first window 35 may be disposed on an inner side of the front end 34F of handle housing 30, through which a trigger 51 extends into opening 33. Trigger 51 is preferably pivotally attached to handle housing 30 via a screw or pin 52. Preferably, trigger 51 pivots about a substantially vertical axis.

Persons skilled in the art will recognize that trigger 51 is part of a power tool switch mechanism 50, and that such switch mechanisms are well known in the art. Switch mechanism 50 may include a switch 52 which is connected to trigger 51, so that the user can move the switch 52 between the "on" and "off" positions, and thus respectively connect and disconnect motor 20M from a power source. In particular, the switch 52 may be a momentarily-closed switch.

Miter saw 10 may have a switch lock-out mechanism 60. Switch lock-out mechanism 60 is preferably disposed within handle housing 30. Switch lock-out mechanism 60 may include a lock-out link 61 pivotably attached to housing 31. Lock-out link 61 preferably pivots about a substantially horizontal axis. Housing 31 may have bosses 31LB to maintain lock-out link 61 in place.

Lock-out link 61 may be pivoted by a first button 62. Preferably housing 31 has a second window 36 through which first button 62 extends. Second window 36 is preferably disposed on the rear end 34R of housing 31, and towards the left side of housing 31. This allows the user to grasp the grip portion 32 with a right hand, and push the first button 62 with the index finger of the right hand (see FIG. 2).

In addition, lock-out link 61 may be pivoted by a second button 63. Preferably housing 31 has a third window 37 through which second button 63 extends. Third window 37 is preferably disposed on the rear end 34R of housing 31, and towards the center and/or right side of housing 31. This allows the user to grasp the grip portion 32 with a left hand, and push the second button 63 with the index finger of the left hand (see FIG. 3).

Preferably, first and second buttons 62, 63 are connected via a bar 64. Housing 31 may have bosses 31BB for slidably receiving bar 64 and limiting its movement along a substantially vertical axis. Bar 64 (and thus first and second buttons 62, 63) may be biased upwardly by springs 65. Housing 31 may have bosses 31SB for maintaining springs 65 therewithin.

Persons skilled in the art will recognize that, while such arrangement may bias the bar 64 outwardly, it may cause first and second buttons 62, 63 to rock when either is pushed downwardly. Accordingly, it may be preferable to provide a mechanism for eliminating such rocker, such as the mechanisms used for limiting the rocker action of a spacebar in a computer keyboard. Persons skilled in the art are referred to the following U.S. patents, which disclose such anti-rocker mechanisms and are wholly incorporated by reference: U.S. Pat. Nos. 4,392,037, 4,950,093, 4,535,210, 4,453,063, 4,384,796, 3,962,556, 3,720,801, and 3,292,761.

With such arrangement, switch lock-out mechanism 60 works as follows. Lock-out link 61 may be pivoted between two positions. In the first position, lock-out link 61 contacts trigger 51 (see FIG. 4A). Preferably, lock-out link 61 has surfaces 61S for contacting trigger 51. Because of such contact, trigger 51 cannot be pivoted towards the "on" position (thus preventing switch 52 from closing and motor 20M from receiving power). A spring 66 may be disposed between housing 31 and lock-out link 61 to bias lock-out link 61 towards the first position.

Figure 4A:
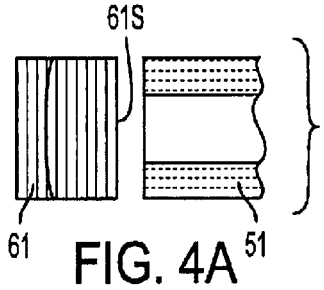
FIGS. 4A-4B show the lock-out link moving between first and second positions, respectively.
Figure 4B:
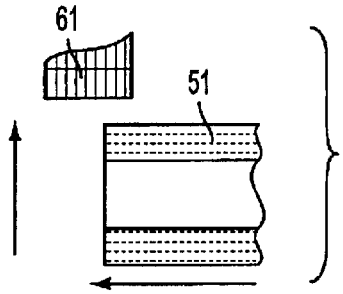

In the second position, lock-out link 61 does not contact trigger 51 (see FIG. 4B). Because of such lack of contact, trigger 51 can be pivoted towards the "on" position, thus closing switch 52 and providing power to motor 20M. Such second position can be reached by the user downwardly pushing either the first or second buttons 62, 63, as explained above and shown in FIGS. 2–3. This causes the lock-out link 61 to pivot, moving surface 61S out of alignment with trigger 51.

When the user releases the trigger 51, the trigger 51 will move back to the "off" position, thus opening switch 52 and cutting off power to motor 20M. Furthermore, when the user releases either the first or second buttons 62, 63, the springs 65 move bar 64 upwardly, decreasing the pressure of first button 62 unto lock-out link 61.

Spring 66 can then return lock-out link 61 to the first position of FIG. 4A. Persons skilled in the art will recognize that, if strong enough, spring 66 can return lock-out link 61 to the first position without assistance from springs 65.

Persons skilled in the art may recognize other additions or alternatives to the means disclosed herein. However, all these additions and/or alterations are considered to be equivalents of the present invention.

What is claimed is:

1. A power tool comprising:

a motor;

a housing forming a handle;

a power switch disposed within the handle operatively associated with the motor, the power switch being movable between "on" and "off" positions via a trigger which is pivotable about a first axis;

a lock-out link pivotably attached to the housing, the lock-out link movable between a first position contacting the power switch for preventing movement of the power switch to the "on" position, and a second position not contacting the power switch, allowing movement of the power switch to the "on" position, the lock-out link pivoting between the first and second positions about a second axis non-parallel to the first axis; and a first button disposed on the housing for moving the lock-out link between the first and second positions.

2. The power tool of claim 1, further comprising a second button disposed on the housing for moving the lock-out link between the first and second positions.

3. The power tool of claim 2, wherein the first and second buttons extend from the housing.

4. The power tool of claim 2, wherein the first and second buttons are interconnected.

5. The power tool of claim 2, further comprising a spring biasing the first and second buttons out of the housing.

6. The power tool of claim 1, wherein the first and second axes are substantially perpendicular.

7. The power tool of claim 1, wherein the power switch is a momentarily closed switch.

8. The power tool of claim 1, wherein the housing defines an opening.

9. The power tool of claim 8, wherein the trigger extends into the opening.

10. The power tool of claim 8, wherein the opening has a first side and a second side opposite to the first side, the trigger being disposed on the first side of the opening.

11. The power tool of claim 10, wherein the first button is disposed near the second side.

12. The power tool of claim 1 wherein the handle comprises a grip portion extending in a substantially horizontal plane, and the trigger protruding out of said housing on an inner side of the grip portion.

13. The power tool of claim 1, wherein the motor drives a blade.

14. The power tool of claim 1, wherein the power tool is a miter saw.

15. The power tool of claim 1, wherein the first axis is substantially vertical.

16. The power tool of claim 1, wherein the second axis is substantially horizontal.

* * * * *